United States Patent [19]

Olin et al.

[11] 4,366,050

[45] Dec. 28, 1982

[54] SCHEELITE FLOTATION

[75] Inventors: Eric J. Olin, Arvada; Harry B. Carson; Brian Ball, both of Golden, all of Colo.

[73] Assignee: Amax Inc., Greenwich, Conn.

[21] Appl. No.: 225,911

[22] Filed: Jan. 19, 1981

[51] Int. Cl.[3] ..... B03D 1/14

[52] U.S. Cl. ..... 209/167; 209/166

[58] Field of Search ..... 209/166, 167

[56] References Cited

U.S. PATENT DOCUMENTS

| | | | |
|---|---|---|---|
| 1,953,431 | 4/1934 | Patek | 209/166 X |
| 2,040,187 | 5/1936 | Rose | 209/167 |
| 2,120,485 | 6/1938 | Clemmer | 209/167 |
| 2,373,305 | 4/1945 | Gieseke | 209/167 X |
| 2,741,364 | 4/1956 | Wilson | 209/166 X |
| 3,589,622 | 6/1971 | Weston | 209/166 X |
| 3,915,391 | 10/1975 | Mercade | 209/166 X |
| 3,985,645 | 10/1976 | Noblitt | 209/166 |
| 4,040,519 | 8/1977 | Fukazawa | 209/166 |
| 4,054,442 | 10/1977 | Vedova | 209/166 |

*Primary Examiner*—Norman Yudkoff

*Attorney, Agent, or Firm*—Michael A. Ciomek

[57] ABSTRACT

A scheelite concentrate is recovered from a scheelite ore containing silicate minerals and other calcareous minerals by froth flotation which process comprises grinding the ore sufficiently fine to liberate the scheelite grains, pulping the gound ore with water to form a slurry containing between about 20% and about 40% solids by weight, sequentially conditioning the slurry with at least one alkali metal carbonate in small but effective amounts to provide an alkaline pH adjustment and a source of carbonate ions, with small but effective amount of alkali metal silicates to depress siliceous and calcareous gangue minerals other than scheelite and with a fatty acid collector in small but effective amounts to coat the scheelite grains, the conditioning with the fatty acid collector being conducted with sufficient agitation to disintegrate floccules of scheelite, silicate mineral and other calcareous mineral grains and to preferentially reflocculate the scheelite grains for a period of time sufficient to produce upon flotation a concentrate having a grade of at least about 50% $WO_3$, adding a frother to the collector conditioned slurry and subjecting the collector conditioned slurry to froth flotation to recover the froth product a scheelite concentration having a grade of at least about 50% $WO_3$.

11 Claims, 1 Drawing Figure

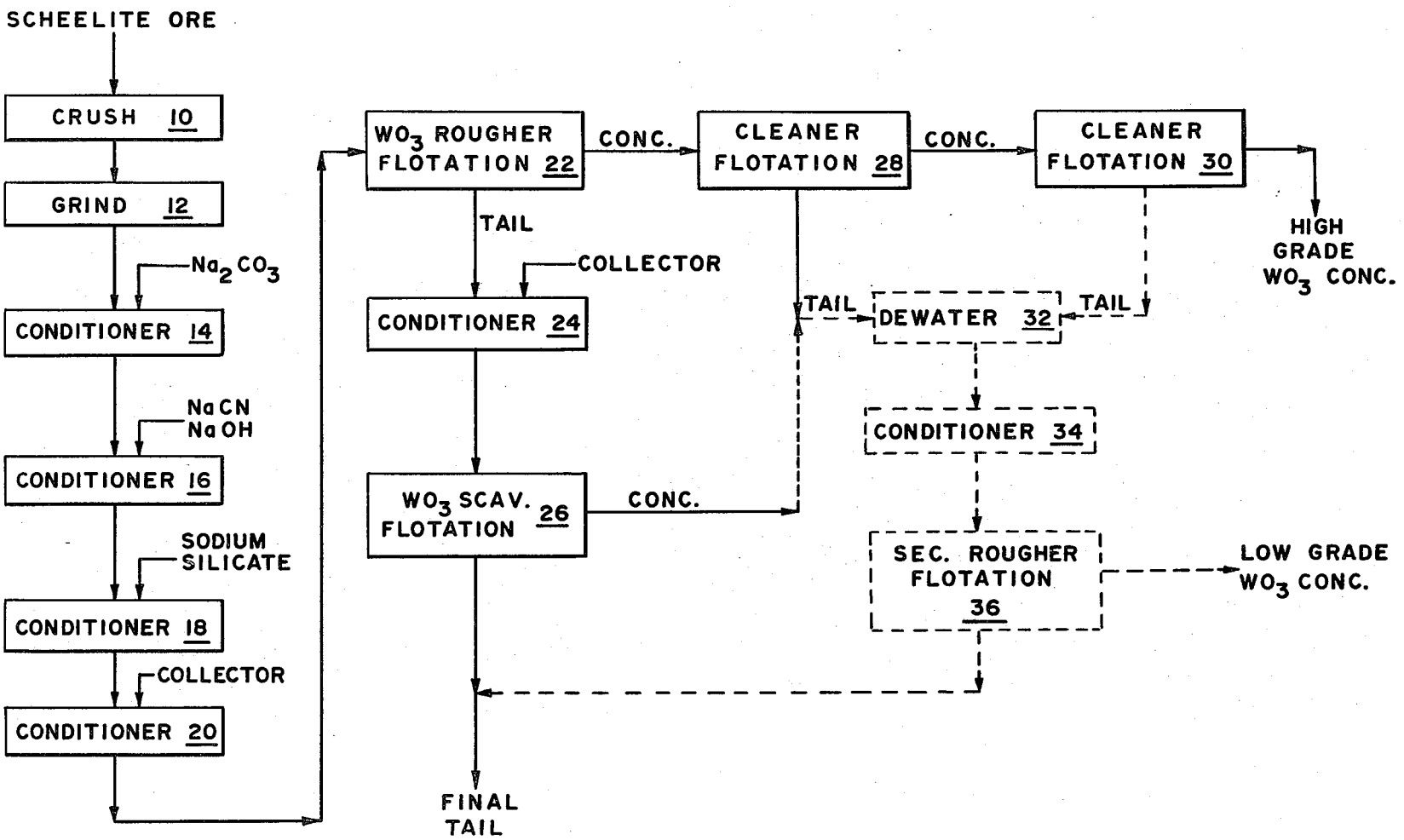
SCHEELITE ORE
CRUSH 10
GRIND 12
$Na_2CO_3$
CONDITIONER 14
NaCN
NaOH
CONDITIONER 16
SODIUM SILICATE
CONDITIONER 18
COLLECTOR
CONDITIONER 20
$WO_3$ ROUGHER FLOTATION 22
CONC.
TAIL
COLLECTOR
CONDITIONER 24
$WO_3$ SCAV. FLOTATION 26
CONC.
FINAL TAIL
CLEANER FLOTATION 28
CONC.
TAIL
DEWATER 32
TAIL
CONDITIONER 34
SEC. ROUGHER FLOTATION 36
LOW GRADE $WO_3$ CONC.
CLEANER FLOTATION 30
HIGH GRADE $WO_3$ CONC.

SCHEELITE FLOTATION

FIELD OF THE INVENTION

The present invention relates to the beneficiation of scheelite ores and more particularly to the recovery of a scheelite concentrate by froth flotation.

BACKGROUND OF THE INVENTION

The major tungsten mineral in many tungsten ores is scheelite, $CaWO_4$. Scheelite ores have been treated by gravity techniques and froth flotations to produce scheelite concentrates. Gravity techniques work reasonably well for coarse grained scheelite and froth flotation must be resorted to if fine grain scheelite is present in the ore. Concentration of scheelite by froth flotation provides acceptable recoveries but difficulties are encountered in the production of high grade concentrates with acceptable recoveries.

Scheelite in scheelite ores is generally disseminated in host rocks having as their major constituents silicate and calcareous minerals. Typical silicate minerals include pyroxene, mica, amphibole, garnet and epidote. Typical calcareous minerals include calcite, apatite, collophane and fluorite. Sulfide minerals are also commonly present in scheelite ore and are, in the absence of special precautions, rendered flotable to some extent by the same collectors used for scheelite. Substantial amounts of these silicate and calcareous minerals are floated with the scheelite thereby lowering the grade of the scheelite concentrate. Although the silicate and calcareous minerals can be depressed by suitable conditioners, scheelite recovery frequently suffers because some of the scheelite is depressed along with the silicate and other calcareous minerals.

Attempts have been made to solve this dilemma of sacrificing grade for recovery or recovery for grade. For example, Mercade in U.S. Pat. No. 3,915,391 discloses a process for recovering a scheelite concentrate from a low grade scheelite ore. Finely divided scheelite ore is conditioned at a high pH using intense agitation in the presence of predetermined quantities of freshly prepared metal sols and in the presence of starvation amounts of a fatty acid collector. The thus-conditioned pulp is subjected to froth flotation to recover a froth of the scheelite concentrate. Although this process works reasonably well, the necessity for using freshly prepared metal sols increased the complexity and costs of the overall process.

SUMMARY OF THE INVENTION

Briefly stated, the present invention comprises a process for recovering a scheelite concentrate by froth flotation from a scheelite ore containing silicate minerals and other calcareous minerals. The process comprises grinding the ore sufficiently fine to liberate the scheelite grains while minimizing the production of slimy fines, pulping the ore with water to form a slurry, conditioning the slurry with at least one alkali metal carbonate in small but effective amounts to depress the silicate minerals, conditioning, if necessary, the carbonate-conditioned slurry with sufficient alkali metal hydroxide to adjust the pH values to between about 10 and about 11, conditioning the pH-adjusted slurry with a water-soluble alkali metal silicate in small but effective amounts to depress calcareous minerals other than scheelite, adding to the silicate-conditioned slurry a fatty acid collector in small but effective amounts to coat the scheelite grains, agitating the slurry to which the collector has been added with sufficient intensity to disintegrate floccules of scheelite, silicate grains and other calcareous mineral grains and to preferentially reflocculate the scheelite grains for a time sufficient to produce upon flotation a concentrate having a grade of at least about 50% $WO_3$, adding a frother to the collector-conditioned slurry and subjecting the collector-conditioned slurry to froth flotation to recover as a froth product a scheelite concentrate having a grade of at least about 50% $WO_3$.

DESCRIPTION OF THE DRAWINGS

The FIGURE is a block diagram of a preferred embodiment of a process in accordance with the present invention.

DETAILED DESCRIPTION OF THE INVENTION

Scheelite ores containing at least about 0.1% $CaWO_4$, advantageously at least about 0.2%, and up to 5% can be treated by the process in accordance with the present invention. Other constituents which can be present include silicate minerals such as pyroxene, mica, amphibole, garnet and epidote and other calcareous minerals such as calcite, fluorite, apatite, and collophane. In addition to ores, tailings produced by gravity separation processes can also be treated. The term "ore" as used herein refers to both ore and tailings from flotation and gravity separation processes.

In order to insure acceptable recoveries, the scheelite ore must be ground to a sufficient fineness to liberate the scheelite grains from the host rock. However, grinding should not be so fine that sliming is encountered. The ore is generally ground to a particle size of at least about 60% minus 200 mesh (U.S.S. screen size). Advantageously, the ore is ground to a particle size between about 50% minus 400 mesh and about 25% plus 200 mesh. Grinding can be conducted by conventional processes.

After grinding, the ground ore is pulped with water to form a slurry containing between about 20% and about 40% solids, by weight, and advantageously between about 25% and about 35% solids, by weight. Although it is advantageous to employ fresh water in forming the slurry, up to about 70%, and advantageously about 50%, recycled water can be employed.

The slurried ore is first conditioned with an alkali metal carbonate in small but effective amounts to depress the silicate minerals while minimizing the depression of the scheelite grains. The amount of alkali metal carbonate added to the slurry is partially dependent upon the silicate mineral content of the ore. Increasing amounts of silicate mineral in the ore generally require somewhat larger additions of the alkali metal carbonate. However, in most instances, alkali metal carbonate additions, between about 5 pounds and about 15 pounds per ton of dry ore, advantageously between about 8 pounds and about 10 pounds per ton of dry ore, are effective in depressing the silicate minerals without significantly depressing the scheelite grains. Examples of alkali metal carbonate that can be employed include sodium carbonate and potassium carbonate. The slurry is then conditioned for a sufficiently long time to depress the silicate minerals. Conditioning can be conducted in a tank with moderate agitation and with conditioning times ranging between about 0.5 minutes and about 10 minutes, advantageously, between about 2 minutes and about 5 minutes.

Following carbonate conditioning, the pH of the slurry is adjusted to a value between about 10 and about 11, advantageously to a value between about 10.5 and about 10.8. The pH value of the slurry can be adjusted to these values by the addition of alkali metal hydroxides, such as sodium hydroxide or potassium hydroxide. If the pH value of the slurry after carbonate conditioning falls within the foregoing ranges, this pH adjustment step can be omitted. Controlling the pH value of the slurry within the foregoing ranges insures maximum depression of the calcareous minerals other than scheelite, thereby insuring a high grade scheelite concentrate with good recoveries. If pH adjustment is required, the slurry is conditioned for a time between about 0.5 minutes and about 10 minutes, advantageously, between about 2 minutes and about 5 minutes, with moderate agitation in order to minimize any concentration gradients within the slurry.

After pH adjustment, the slurry is conditioned with an alkali metal silicate which both depresses calcareous minerals other than scheelite and acts as a dispersant as described in greater detail hereinafter. An important advantage of the present invention is that commercially available alkali metal silicates can be employed. The silicates can advantageously, be formed into an aqueous solution prior to the addition to the slurry. The use of aqueous solution of alkali metal silicates improves the effectiveness of these reagents. Advantageously, aqueous solutions containing between about 1% and about 20% alkali metal silicates provide the best results. Alkali metal silicates are added to the slurry in small but effective amounts to depress calcareous minerals other than scheelite while minimizing the depressing effects on scheelite. The amount of alkali metal silicate added to the slurry will be partially dependent upon the quantities of calcareous minerals other than scheelite that are present in the ore with increasing amounts of alkali metal silicate being required for those ores containing greater amounts of other calcareous minerals. Generally, however, alkali metal silicate additions ranging between about 3 pounds and about 10 pounds per ton of dry ore, and advantageously between about 5 pounds and 8 pounds per ton of dry ore, are effective in depressing calcareous minerals other than scheelite without unduly depressing the scheelite. Examples of alkali metal silicates that can be used include sodium silicate and potassium silicate.

A fatty acid collector is then added to the silicate conditioned slurry. The fatty acid collector is added to the slurry in small but effective amounts to activate the scheelite grains for flotation while minimizing the activation of other oxide minerals. Again, the amount of fatty acid collector added to the slurry is dependent upon the nature of the ore. In most instances, fatty acid collector additions between about 0.05 pound and 0.25 pound per ton of dry ore, advantageously, between about 0.08 pound and about 0.14 pound per ton of dry ore, are effective in maximizing scheelite flotation while minimizing the flotation of other oxide minerals. Examples of fatty acid collectors that can be employed include oleic acid, linoleic acid and tall oils in combination with an emulsifying agent or a combination thereof. Advantageously, a mixture of oleic and linoleic acid is preferred as a fatty acid collector. After the fatty acid collector is added to the slurry, the slurry is then conditioned.

Conditioning of the slurry to which the collector has been added is an important feature of the present invention. Both the time of agitation and the intensity of agitation are important factors in providing high grade concentrates with good recoveries. Intense agitation is more important than conditioning time in that if the agitation is not sufficient either unduly long conditioning periods are required or selective flocculation does not occur at all. The intensity of agitation required to selectively flocculate the collector coated scheelite grains is dependent upon the nature of the ore. If the scheelite is present in the ore as very small grains, the ore must be ground to sufficiently small particle size to liberate the scheelite grains and the intensity of agitation must be increased in order to provide selective flocculation of the scheelite grains. The term "intense agitation" as used herein refers to agitation at least equivalent to that supplied to a double 2.5 inch diameter ship type impeller rotated at at least 2,000 revolutions per minute in a slurry 12 inches to 14 inches deep which contains 30% solids by weight and which is contained in a cylindrical conditioning tank having an inside diameter of 8 inches with 4 vertically disposed baffles extending radially 0.5 inch into the tank. Intense agitation of this magnitude provides sufficient shear forces to the slurry to disintegrate floccules of silicate minerals, other calcareous minerals and scheelite grains and to flocculate selectively the collector coated, highly dispersed scheelite grains. Using this intensity of agitation and conditioning time of at least about 5 minutes, and advantageously between about 15 minutes and about 20 minutes, is sufficient to produce upon froth flotation a scheelite concentrate containing at least about 50% $WO_3$ with good recoveries.

The collector conditioned slurry is then subjected to froth flotation after the addition of a frother to produce a froth product which is a scheelite concentrate. Frothers that can be employed include homologues of sodium sulfo-succinate esters of fatty acid aklanolamides and other wetting agents compatible with the collector. Flotation can be conducted in conventional flotation machines for period of time ranging between about 4 minutes and about 15 minutes. Shorter flotation periods do not provide acceptable scheelite recoveries while longer flotation times can result in a lower grade product.

As noted hereinbefore, scheelite ores can also contain small amounts of floatable sulfide minerals such as pyrite and pyrrhotite. It is common practice in the art to prefloat such sulfides prior to scheelite flotation. It has now been discovered that such preflotation of sulfide minerals can lower overall scheelite recoveries. An important feature of the present invention is the use of a sulfide depressant when sulfides are present. Examples of reagents that depress sulfide flotation include sodium cyanide, potassium cyanide, and sodium thioglycolate. The sulfide depressant is added to the ore after conditioning with the alkali metal carbonate. When it is desirable to depress sulfide minerals, the reagents are employed in amounts between about 0.01 pounds and 2 pounds per ton of dry ore and advantageously in amounts between about 0.3 pounds and about 0.07 pound per ton of dry ore.

An advantageous embodiment for carrying the present invention into practice is depicted in the Figure. Scheelite ore is fed to 10 where it is crushed to minus 10 mesh, and the crushed ore is then fed to grinding mills 12 where it is ground to 100% minus 65 mesh which corresponds to a particle size distribution of less than about 25% plus 200 mesh and less than about 55% minus 400 mesh. Although grinding to finer particle sizes might liberate further amounts of scheelite from the host rock, some of the scheelite is so finely grained that recovery tends to drop off when conventional flotation techniques are employed. Grinding of the scheelite ores to the foregoing particle size ranges can be achieved by wet grinding in a rod or ball mill. After grinding the pulp density of the slurry is adjusted to contain between about 20% and about 40% solids, by weight, advantageously, about 30% solids, by weight.

The slurry from grinding is fed to conditioner 14 where the slurry is conditioned with an alkali metal carbonate, e.g., soda ash, which acts as a pH modifier and the carbonate ion acts to depress silicate minerals. Soda ash is added to the slurry in amounts between about 4 pounds and about 12 pounds per ton of dry ore. Soda ash additions in excess of 12 pounds per ton of dry ore provide less selective flotation as evidenced by a drop in the grade of the concentrate. Soda ash conditioning can be conducted in an agitated tank for times ranging between about 0.2 minutes and about 5 minutes.

The soda ash-conditioned slurry is then fed to conditioner 16, where if necessary, an alkali metal hydroxide, such as sodium hydroxide, is added to the slurry to modify the pH value to between about 10.5 and 11. If the ore contains significant amounts of sulfides, reagents to depress sulfide flotation can be added at this time. For example, if the ore contains small amounts of sulfide minerals such as pyrrhotite, pyrite and chalcopyrite, these minerals can be depressed by adding an alkali metal cyanide, such as sodium cyanide, to the slurry. Sulfide depressants can be added to the slurry in amounts ranging between about 0.01 and 2 pounds per ton of dry ore and advantageously in amounts ranging between about 0.03 and about 0.07 pounds per ton of dry ore. After the alkali metal hydroxide and the alkali metal cyanide is added to to the slurry, the slurry is conditioned for a time ranging from about 2 minutes to about 5 minutes with moderate agitation.

After pH modification, the slurry is fed to conditioner 18 where a dispersant e.g., an alkali metal silicate, is added to the pH-adjusted slurry to disperse calcareous minerals such as calcite, fluorite and apatite. The amount of alkali metal silicate added to the pH-adjusted slurry can range between about 3 pounds and about 10 pounds per ton of dry ore and advantageously, between about 5 pounds and 8 pounds per ton of ore. After adding the dispersant to the slurry the slurry is conditioned for short times with moderate agitation.

The dispersant-conditioned slurry is then fed to conditioner 20 where a fatty acid collector in small but effective amounts to coat the scheelite grains is added to the slurry. The amount of fatty acid added to the slurry can range between about 0.05 and about 0.25 pound per ton of dry ore and advantageously between about 0.08 pound and about 0.14 pound per ton of dry ore. After adding the fatty acid collector to the slurry, the slurry is subjected to intense agitation for a time sufficient to insure the production of a scheelite concentrate having a $WO_3$ content of at least about 50% upon flotation. In most instances, conditioning times of at least about 15 minutes are sufficient to produce upon flotation a scheelite concentrate having a $WO_3$ content of about 50% or more. Advantageously conditioning times of at least 20 minutes are employed.

A frother, such as a homolog of sodium sulfo-succinate esters of fatty acid alkanolamides, is added to the collector conditioned slurry. The amount of frother added to the slurry can range between about 0.1 pounds and about 0.3 pounds per ton of dry ore. The slurry containing the frother is then sent to flotation machines 22 where a froth product containing the scheelite concentrate is recovered. The flotation time has a significant impact on concentrate grade. In most instances, it is advantageous to limit flotation times to less than about 8 minutes. Flotation times exceeding 8 minutes produce scheelite concentrates having significantly lower $WO_3$ contents. Advantageously, flotation times range between about 2 minutes and about 4 minutes. Flotation times within this range provide scheelite recoveries of about 80% and concentrate grades of about 50% or more. Flotation is advantageously conducted at a temperature between about 10° C. and about 35° C., e.g., 25° C. Pulp temperatures exceeding about 35° C. result in lower grade concentrates with high recoveries while temperatures lower than about 20° C. provide lower recoveries.

Additional fatty acid collector in amounts between about 0.1 pound and about 0.5 pound per ton of dry ore, e.g. about 0.2 pound per ton of dry ore is added to the underflow along with additional frother in an amount between about 0.05 pound and about 0.2 pound per ton of dry ore, e.g., about 0.1 pound per pound of dry ore. After the addition of these reagents, the underflow is conditioned at 24 with moderate agitation for times between about 2 minutes and about 10 minutes, e.g. about 5 minutes. The conditioned underflow is sent to flotation machine 26 where the underflow is scavenged to recover residual amounts of material from the tailings from flotation machine 22.

The froth product from flotation machine 22 is sent to flotation machine 28 to clean the rougher flotation product. The flotation product from flotation machine 28 is sent to a second cleaning operation in flotation machine 30 to produce a froth product of a high grade scheelite concentrate. Additional steps of cleaning may be required to produce the required product purity.

The froth product from flotation machine 26 and the underflow from flotation machines 28 and 30 are sent to thickener 32 where the solids content of the scavenging flotation concentrate and the tailings from the two cleaner flotations is adjusted to between about 20% solids and about 30% solids, by weight. The underflow from thickener 32 is sent conditioner 34 where additional frother and collector are added and then the slurry is conditioned with moderate agitation for a short time. The thus-conditioned slurry is sent to flotation machine 36 where a froth product containing a low grade scheelite concentrate is produced. This low grade concentrate can be treated separately from the high grade concentrate to recover tungsten therefrom. The underflow from flotation machine 34 is combined with the underflow from flotation machine 26 and is sent to a tailings pond. In order to give those skilled in the art a better understanding of the present invention, the following illustrative examples are given.

EXAMPLE I

A scheelite ore containing 2.0% scheelite, 12.6% pyrrhotite, 3.3% pyrite, 0.6% chalcopyrite, and the balance (81.5%) gangue minerals and crushed to minus 10 mesh. Gangue minerals included pyroxene, amphibole, mica, chlorite, calcite, apatite, collophane, epidote and sphene. A 1000 gram sample of the minus 10 mesh material was pulped with water to form a slurry containing 67% solids, by weight, and was then charged into an 8" by 10" rod mill charged with 12 kilograms of ¾" monosized rods. The charge was ground to a particle size range of 0.7% minus 70 plus 100 mesh, 4.8% minus 100 mesh plus 140 mesh, 17.3% minus 140 mesh plus 200 mesh, 11.9% minus 200 mesh plus 270 mesh, 13.4% minus 200 mesh plus 400 mesh and 51.9% minus 400 mesh.

The ground ore was pulped with water to provide a slurry containing 30% solids by weight. Sodium carbonate in an amount equivalent to 10 pounds per ton of dry ore was added to the slurry and the slurry was fed to a cylindrical conditioning tank having an inside diameter of 8 inches with four vertically disposed baffles radially extending ½ inch into the tank. The slurry in the tank was between 4 inches and 5 inches deep and was agitated with a double 2.5 inches ship type impeller rotated at 1,500 r.p.m. for five minutes. Thereafter, sufficient sodium hydroxide to raise the pH value of the slurry to 10.9 was added together with sodium cyanide in an amount equivalent to 0.05 pound per ton of dry ore. The slurry was again conditioned by rotating the impeller at 1,500 r.p.m. for 5 minutes. After this conditioning step sodium silicate in an amount equivalent to 5 pounds per ton of dry ore was added to the slurry and the slurry was conditioned for five minutes while rotating the impellar at 1,500 r.p.m. When silicate conditioning was completed, a fatty acid containing approximately 50% each of oleic acid and linoleic acid, sold under the Trademark PAMAK W-4, (produced and sold by Hercules) was added to the slurry at a rate equivalent to 0.09 pounds per ton of dry ore. The slurry was then conditioned for 20 minutes with the impeller rotating at 2700 r.p.m. A frother containing sulfo-succinic esters of fatty acid alkanolamides was added to the collector-conditioned slurry at a rate equivalent to 0.16 pound per ton of dry ore.

The slurry was then subjected to a rougher flotation for 7 minutes while rotating the impeller at 1500 r.p.m. The rougher concentrate derived from the froth product contained 81.3% of the $WO_3$ contained in the ore and had a grade of 63.8% $WO_3$. The rougher concentrate at 2% solids by weight was refloated for seven minutes while rotating the impeller at 1,000 r.p.m. The froth from the first cleaning operation was refloated again at 2% solids, by weight, for seven minutes with the addition of further amounts of the same frother at a rate equivalent to 0.06 pound per ton of concentrate. The scheelite concentrate derived from the froth of the second cleaning operation contained 80.5% of the $WO_3$ contained in the ore and had a grade of 76.9%.

The underflow from the rougher flotation containing 20% solids by weight was refloated for 5 minutes to produce a scavenger flotation concentrate to recover fully amounts of scheelite as a low grade scheelite concentrate.

EXAMPLE II

In order to demonstrate the importance of the sequence of adding the conditioning reagents, five tests were conducted in substantially the same manner as described in Example I, except that the sequence in which the conditioning reagents were added was changed. The results of these tests are reported in Table I.

TABLE I

| | | Cleaner Conc. | | Rougher Conc. | | Scav. Conc. | |
|---|---|---|---|---|---|---|---|
| Test | Sequence of Reagent Conditioning | % $WO_3$ | $WO_3$ Dist. | % $WO_3$ | $WO_3$ Dist. | % $WO_3$ | $WO_3$ Dist. |
| 1 | $Na_2CO_3$, NaOH/NaCN, sodium silicate | 72.1 | 73.44 | 52.90 | 74.22 | 21.78 | 7.17 |
| 2 | $Na_2CO_3$, sodium silicate, NaOH/NaCN | 63.1 | 78.75 | 48.58 | 79.35 | 5.82 | 4.65 |
| 3 | Sodium silicate, NaOH/NaCH, $Na_2CO_3$ | 35.4 | 75.04 | 29.75 | 75.85 | 6.67 | 6.72 |
| 4 | Sodium silicate, $Na_2CO_3$, NaOH/NaCN | 35.4 | 74.09 | 30.25 | 74.84 | 6.80 | 4.98 |
| 5 | Sodium silicate, $Na_2CO_3$/NaOH/NaCN | 37.2 | 73.46 | 29.37 | 74.46 | 5.61 | 5.05 |

Analysis of the results presented in Table I clearly demonstate that conditioning first with sodium carbonate, then with sodium hydroxide and sodium cyanide followed by sodium silicate conditioning and finishing up with collector conditioning produces a cleaner concentrate containing 73.44% of the $WO_3$ with a concentrate grade of 72.1% and a scavenger concentrate containing 7.17% of the $WO_3$ contained in the ore with a concentrate grade of 21.78%. Thus, sequencing the reagent additions in accordance with the present invention provides an overall recovery of 80.5% and high grade cleaner and scavenger concentrates. Tests 2 to 5 on the other hand demonstate that when the conditioning reagents are added in a sequence outside the scope of the present invention provide recoveries equivalent to those obtained by those obtained by the process in accordance with the present invention but both the cleaner concentrate and the scavenger concentrates have substantially lower grades.

EXAMPLE III

This Example confirms the importance of using intense agitation when conditioning the slurry with the collector. Five tests were conducted on the ore in the manner described in Example I except that the collector conditioning was conducted at different impeller speeds ranging from 1500 to 2700 r.p.m. The results of these tests are reported in Table II.

TABLE II

| | | Rougher Conc. | | Cleaner Conc. | |
|---|---|---|---|---|---|
| Test No. | Rpm | % $WO_3$ | $WO_3$ Dist. | % $WO_3$ | $WO_3$ Dist. |
| 6 | 1,500 | 32.1 | 84.44 | 44.3 | 83.34 |
| 7 | 1,800 | 35.7 | 88.67 | 57.1 | 87.45 |
| 8 | 2,100 | 49.7 | 87.02 | 65.3 | 85.41 |
| 9 | 2,400 | 50.7 | 84.30 | 66.3 | 82.98 |
| 10 | 2,700 | 55.5 | 85.00 | 72.0 | 81.50 |

Reference to Table II confirms that overall recovery in the cleaner concentrate fluctuates a few percentage points above and below 84% and appears to be independent of the impeller speed. However, rougher and cleaner concentrate grades were found to be significantly dependent upon the impeller speed. For example, the cleaner concentrate grade is improved to 72% at an impeller speed of 2,700 r.p.m. and falls to 44.3% $WO_3$ at 1,500 r.p.m. This example clearly shows the importance of intense agitation during collector conditioning.

EXAMPLE IV

This Example demonstrates the importance of the collector conditioning time. Four tests conducted on the ore in the manner described in Example I with conditioning times being varied from five minutes to twenty minutes with the impeller being rotated at a speed of 2,700 r.p.m. The results of these tests are reported in Table III.

The results presented in Table III show recoveries are independent of time but that longer conditioning times enhance cleaner concentrate grades. Thus, conditioning for twenty minutes produces a concentrate that is 1.2 times more concentrated in $WO_3$ than the concentrate that was collector conditioned for only five minutes.

Although the present invention has been described in connection with the preferred embodiments, it is understood that modifications and variations may be resorted to without departing from the essense and scope of the invention as those skilled in the art will readily understand. Such modifications and variations are considered to be within the perview and scope of the appended claims.

TABLE III

| | | Rougher Conc. | | Cleaner Conc. | |
|---|---|---|---|---|---|
| Test No. | Conditioning Time (min.) | % $WO_3$ | $WO_3$ Dist. | % $WO_3$ | $WO_3$ Dist. |
| 11 | 5 | 37.2 | 84.83 | 61.4 | 83.85 |
| 12 | 10 | 45.6 | 85.77 | 61.9 | 84.26 |
| 13 | 15 | 47.9 | 82.57 | 67.3 | 81.38 |
| 14 | 20 | 55.5 | 85.00 | 72.0 | 81.50 |

We claim:

1. A process for recovering a scheelite concentrate by froth flotation from a scheelite ore containing silicate minerals, other calcareous minerals and sulfide minerals which comprises grinding the ore sufficiently fine to liberate the scheelite grains while minimizing production of slimy fines; pulping the ore with water to form a slurry; conditioning the slurry with at least one alkali metal carbonate in small but effective amounts to depress the silicate minerals, the slurry having a pH value between about 10 and 11; conditioning the carbonate-containing slurry with an alkali metal cyanide in small but effective amounts to depress the sulfide minerals; conditioning the pH-adjusted slurry with at least one water-soluble alkali metal silicate selected from the group consisting of sodium silicate and potassium silicate in small but effective amounts to depress calcareous minerals other than scheelite; adding to the silicate-conditioned slurry at least one fatty acid collector selected from the group consisting of oleic acid, linoleic acid and tall oils in conjunction with an emulsifying agent in small but effective amounts to coat the scheelite grains; agitating the slurry to which the collector has been added with sufficient intensity to disintegrate floccules of scheelite, scheelite grains and other calcareous mineral grains and to preferentially reflocculate the scheelite grains for a time sufficient to produce upon flotation a concentrate having a grade of at least about 50% $WO_3$; adding a frother to the collector-conditioned slurry; and subjecting the collector-conditioned slurry to froth flotation to recover as a froth product a scheelite concentrate having a grade of at least 50% $WO_3$.

2. The process as described in claim 1 wherein an alkali metal hydroxide is added to the carbonate-conditioned slurry if the pH value of the carbonate-conditioned slurry is less than about 10 to raise the pH value of the carbonate-conditioned slurry to a value between about 10 and about 11.

3. The process as described in claims 1 wherein the ore is ground to a particle size of at least about 60% minus 200 mesh.

4. The process as described in claim 3 wherein the ground ore is pulped with water to form a slurry containing between about 20% solids and about 40% solids by weight.

5. The process as described in claim 4 wherein the alkali metal carbonate is added to the slurry in amounts between about 5 pounds and about 15 pounds per ton of dry ore.

6. The process as described in claim 5 wherein the alkali metal silicate is added to the slurry in an amount between about 3 pounds and about 10 pounds per ton of dry ore.

7. The process as described in claim 6 wherein the fatty acid collector is added to the slurry in an amount between about 0.05 pound and about 0.25 pound per ton of dry ore.

8. The process as described in claim 7 wherein the fatty acid is added to the slurry in an amount between about 0.08 pound and about 0.14 pound per ton of dry ore.

9. The process as described in claim 7 wherein the fatty acid collector is a mixture of oleic and linoleic acid.

10. The process as described in claim 7 wherein the slurry to which the collector has been added is agitated for at least about 5 minutes.

11. The process as described in claim 10 wherein the pH value of the slurry is maintained at a value between about 10.5 and about 10.8 .

* * * * *